US012352263B2

(12) United States Patent
Adler et al.

(10) Patent No.: US 12,352,263 B2
(45) **Date of Patent: *Jul. 8, 2025**

(54) COMPRESSOR AND METHOD FOR COMPRESSING A WORKING MEDIUM

(71) Applicant: MAXIMATOR GMBH, Nordhausen (DE)

(72) Inventors: Robert Adler, Vienna (AT); Georg Fahrthofer, Vienna (AT); Sarah Gruber, Vienna (AT); Christoph Nagl, Vienna (AT); Markus Rasch, Vienna (AT); Markus Stephan, Vienna (AT); Henning Willig, Bad Lauterberg (DE); Rene Himmelstein, Sinsheim (DE)

(73) Assignee: MAXIMATOR GMBH, Nordhausen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/330,209

(22) Filed: Jun. 6, 2023

(65) Prior Publication Data

US 2023/0332595 A1 Oct. 19, 2023

Related U.S. Application Data

(62) Division of application No. 16/964,554, filed as application No. PCT/EP2019/051624 on Jan. 23, 2019, now Pat. No. 11,708,828.

(30) Foreign Application Priority Data

Jan. 23, 2018 (EP) ..... 18152932

(51) Int. Cl.

| | |
|---|---|
| ***F04B 53/14*** | (2006.01) |
| ***F04B 53/16*** | (2006.01) |
| ***F04B 53/22*** | (2006.01) |

(52) U.S. Cl.
CPC ..... *F04B 53/143* (2013.01); *F04B 53/16* (2013.01); *F04B 53/22* (2013.01)

(58) Field of Classification Search
CPC ..... F04B 9/129; F04B 9/133; F04B 27/02; F04B 53/02; F04B 53/14; F04B 53/143;
(Continued)

(56) References Cited

U.S. PATENT DOCUMENTS 2,405,120 A * 8/1946 Evans ..... F16C 33/74 29/271
2,707,135 A * 4/1955 Monahan ..... F16J 15/56 384/139

(Continued)

FOREIGN PATENT DOCUMENTS

CN 101191428 A 6/2008
CN 102852768 A 1/2013

(Continued)

OTHER PUBLICATIONS

ISA European Patent Office, International Search Report Issued in Application No. PCT/EP2019/051624, Apr. 12, 2019, WIPO, 4 pages.

*Primary Examiner* — Alexander B Comley
(74) *Attorney, Agent, or Firm* — McCoy Russell LLP

(57) ABSTRACT

A compressor and method for compressing a working medium, including moving a drive piston which is driven by way of a driving medium within a first cylinder between a first end position and a second end position; moving a high pressure piston which compresses the working medium within a second cylinder between a first end position and a second end position; arranging a high pressure seal for sealing the high pressure piston; arranging a magazine having a receptacle for the high pressure seal and at least one replacement high pressure seal in a first operating position, in which the high pressure piston is sealed by way of the (Continued)

high pressure seal; and transferring the magazine from the first operating position to a second operating position, in which the high pressure piston is sealed by way of the replacement high pressure seal.

2 Claims, 16 Drawing Sheets

(58) Field of Classification Search
CPC ..... F04B 53/16; F04B 53/22; F16J 15/3268; F16J 15/3296; F16J 15/56; F16J 15/008
See application file for complete search history.

(56) References Cited

U.S. PATENT DOCUMENTS 2,766,701 A * 10/1956 Giraudeau ..... F04B 53/14 277/525
3,282,167 A * 11/1966 Mckenzie ..... F15B 3/00 417/397
3,773,336 A * 11/1973 Walter ..... F16J 15/008 277/914
4,104,008 A * 8/1978 Hoffmann ..... F04B 53/162 91/309
5,820,132 A * 10/1998 Marnot ..... F16J 15/008 277/572
6,152,454 A 11/2000 Marnot
6,161,838 A * 12/2000 Balsells ..... F16J 15/3212 277/572
6,279,453 B1 * 8/2001 Funck ..... F04B 53/008 92/161
6,544,012 B1 * 4/2003 Blume ..... F04B 53/164 417/454
6,623,259 B1 * 9/2003 Blume ..... F04B 53/164 417/454
7,186,097 B1 * 3/2007 Blume ..... F04B 53/1032 417/454
9,016,693 B1 * 4/2015 Shek ..... F04B 47/00 277/500
2003/0173746 A1 * 9/2003 Ramsay ..... F16J 15/3268 277/549
2009/0175743 A1 * 7/2009 Sakamoto ..... F04B 39/125 417/415
2015/0101679 A1 * 4/2015 Forrest ..... B05B 9/0413 137/237
2016/0138584 A1 * 5/2016 Trevino ..... F04B 53/18 417/434
2017/0292506 A1 * 10/2017 Shultz ..... F04B 17/06
2018/0355861 A1 * 12/2018 Ubidia ..... F04C 15/008
2019/0093616 A1 * 3/2019 Klein ..... F04B 1/0408

FOREIGN PATENT DOCUMENTS

CN 102954225 A 3/2013
CN 104696213 A 6/2015
CN 105008718 A 10/2015
CN 107269499 A 10/2017
CN 107503930 A 12/2017
DE 3321084 A * 12/1984 ..... F16J 15/008
DE 19710717 A1 * 9/1998 ..... F04B 53/008
DE 102014016141 A1 5/2016
EP 3258111 A1 12/2017

* cited by examiner

COMPRESSOR AND METHOD FOR COMPRESSING A WORKING MEDIUM

CROSS-REFERENCE TO RELATED APPLICATIONS

The present application is a divisional of U.S. Non-Provisional patent application Ser. No. 16/964,554, entitled "COMPRESSOR AND METHOD FOR COMPRESSING A WORKING MEDIUM", and filed on Jul. 23, 2020. U.S. Non-Provisional patent application Ser. No. 16/964,554 is a U.S. National Phase of International Patent Application No. PCT/EP2019/051624 entitled "COMPRESSOR AND METHOD FOR COMPRESSING A WORKING MEDIUM," filed on Jan. 23, 2019. International Patent Application No. PCT/EP2019/051624 claims priority to European Patent Application No. 18152932.2 filed on Jan. 23, 2018. The entire contents of each of the above-referenced applications are hereby incorporated by reference for all purposes.

TECHNICAL FIELD

The invention relates to a compressor and a method for compressing a working medium.

BACKGROUND AND SUMMARY

Such compressors are known in the prior art in various designs (cf. e.g. U.S. Pat. No. 4,104,008 A).

U.S. Pat. No. 4,104,008 A discloses a compressed-air-operated hydraulic pump which comprises a working chamber and a pneumatic piston, wherein the pneumatic piston is connected to a hydraulic piston. With the aid of an auxiliary slider which is sealed with respect to the working chamber and a control slider, compressed air is conveyed to the pneumatic piston in order to move this against a spring force of a helical compression spring. Due to the movement of the pneumatic piston, the hydraulic piston is moved in a hydraulic cylinder onto which a valve housing is pushed, which is used for connection of hydraulic lines.

US 2015/101679 A1 discloses a high-pressure fluid system with improved safety, maintenance and service functions which comprises a housing, a valve seat arrangement, a lubrication flow path and an adjustable valve. The adjustable valve is designed to control the flow of a pump fluid from the valve seat arrangement to the sealing arrangement.

DE 197 10 717 A discloses a high-pressure device which comprises a drive means and a pressure-generating means, which can be actuated by means of the drive means to generate pressure in a pressurized fluid. As a result of a frame arrangement, the drive means and the pressure-generating means are detachably connected to one another.

The volume to be compressed must be sealed with respect to the cylinder tube in a reciprocating compressor. In the ideal case the seals have a negligible leakage. Should a leakage occur however due to wear or damage, this is detected in the prior art and the seal is replaced. For this purpose operation of the compressor is stopped wherein optionally switching takes place to a redundantly constructed compressor. A service engineer is then requested who carries out exchange of the seal on site. This service call usually cannot be planned and causes additional journeys and times and therefore high costs. Furthermore, the operator must reckon on down times or provide a redundant systems. However, the latter provides for higher acquisition costs.

At the present time, exchange of the seal usually includes the following steps:

- Relieve pressure of the compressor and attachment parts.
- In the case of highly flammable gases such as molecular hydrogen, an inert gas (e.g. nitrogen) must be flushed before opening the compressor. Depending on the volume, this process can take a large amount of time.
- Dismantle all attachment parts in order to be able to dismantle the seal.
- Dismantle the seal, pull on the new seal (depending on the manner of installation and diameter, seals must be calibrated or headed before installation).
- Assembly of all attachment parts.
- In the case of highly flammable gases, before introduction of the working means an inert gas (e.g. nitrogen) must be flushed. Depending on the volume, this process can take a large amount of time.
- Apply pressure and carry out leakage tests.

Accordingly, it is the object of the invention to alleviate or eliminate at least individual disadvantages of the prior art. In particular, it is the aim of the invention to make the replacement of the high-pressure seal simpler, faster and more cost-effective.

This and other objects are addressed by the embodiments described herein.

A method according to the invention for compressing a preferably gaseous working medium therefore comprises the following steps:

- moving a drive piston driven by means of a drive medium within a first cylinder between a first end position and a second end position;
- moving a high-pressure piston which compresses the working medium within a second cylinder between a first end position and a second end position,
- arranging a high-pressure seal for sealing the high-pressure piston;
- arranging a magazine with a receptacle for the high-pressure seal and with at least one replacement high-pressure seal in a first operating position in which the high-pressure piston is sealed by the high-pressure seal;
- transferring the magazine from the first operating position into the second operating position in which the high-pressure piston is sealed by the replacement high-pressure seal.

A compressor according to the invention comprises:

- a drive piston which can be actuated with a working medium within a first cylinder, wherein the drive piston is movable between a first end position and a second end position;
- a high-pressure piston which compresses the working medium within a second cylinder, wherein the high-pressure piston is movable between a first end position and a second end position; a high-pressure seal for sealing the high-pressure piston;
- a magazine with a receptacle for the high-pressure seal and with at least one replacement high-pressure seal;
- a changeover device with a drive for transferring the magazine between a first operating position for sealing the high-pressure piston by the high-pressure seal and a second operating position for sealing the high-pressure piston by the replacement high-pressure seal.

Advantageously, the exchange of the seal can thus be simplified appreciably. In many cases, no service engineer is required for exchange of the seal. During exchange of the seal, the compressor can remain in operation or ready for operation. According to the invention, at least one replacement high-pressure seal is arranged on the magazine. If the high-pressure seal can no longer ensure sealing of the high-pressure piston as a result of wear or damage, the changeover device is actuated in such a manner that the magazine is brought from the first operating position into the second operating position. In this case, the high-pressure seal is moved from a functional position which seals the high-pressure piston into a waiting position remote from the high-pressure piston. Conversely the replacement high-pressure seal is moved from a waiting position remote from the high-pressure piston into a functional position bearing against the high-pressure piston in which the high-pressure piston is sealed by means of the replacement high-pressure seal in the second cylinder. In the first and second operating position, the high-pressure piston is connected fixedly or detachably to the drive piston so that the high-pressure piston is driven by means of the drive piston. Preferably the drive piston and the high-pressure piston are configured as pressure translators (pressure converters), wherein a lower pressure of the driving medium is converted into a higher pressure of the working medium. If all the (replacement) high-pressure seals are worn, on the one hand the magazine as a whole can be exchanged for a corresponding magazine with unused (replacement) high-pressure seals. On the other hand, only new (replacement) high-pressure seals can be inserted in the magazine as well. For this purpose the magazine can comprise a corresponding access opening. Exchange of the magazines on site functions simply and rapidly. The calibration and introduction of the (replacement) high-pressure seals does advantageously not need to take place on site, but can be prepared. The service interventions for exchanging the seals can thus be planned.

For the purposes of this disclosure, the directional information such as "axial", "radial" relate to the central axis of the high-pressure piston.

Various embodiments are provided for transferring the magazine from the first operating position into the second operating position.

In a first embodiment, the following steps are carried out for transferring the magazine from the first operating position into the second operating position:

- shifting the magazine together with the high-pressure seal arranged in the receptacle relative to the second cylinder substantially in the direction of the central axis of the high-pressure piston from the first operating position into a first intermediate position which releases the high-pressure seal from the high-pressure piston;
- transferring the magazine from the first intermediate position into a second intermediate position which arranges the replacement high-pressure seal substantially coaxially with the high-pressure piston; and
- shifting the magazine together with the replacement high-pressure seal substantially in the direction of the central axis of the high-pressure piston from the second intermediate position into the second operating position.

In this embodiment, the magazine is displaceable in the axial direction in order to enable the withdrawal of the high-pressure seal from the high-pressure piston. The second cylinder on the other hand can be immovable in the axial direction. In the first operating position, the high-pressure seal bears against the outer circumference of the high-pressure piston to seal the back and forth movement of the high-pressure piston. By actuation of the changeover device, the magazine can be shifted in one direction axially into the first intermediate position in which the high-pressure seal, when viewed in the direction of the central axis of the high-pressure piston, is arranged outside the high-pressure piston. The magazine is then moved into the second intermediate position in which the central axes of the replacement high-pressure seal and the high-pressure piston are arranged substantially collinearly. Finally the magazine is shifted axially in the other direction in order to arrange the replacement high-pressure seal sealingly on the high-pressure piston.

In this embodiment, the shifting of the magazine from the first operating position into the first intermediate position preferably comprises the following steps:

- releasing the high-pressure piston from the drive piston,
- arranging the drive piston and the high-pressure piston at a distance from one another
- shifting the magazine from the first operating position substantially in the direction of the central axis of the high-pressure piston so that the high-pressure seal in the first intermediate position, when viewed in the direction of the central axis of the drive piston, is arranged between the high-pressure piston and the drive piston.

After reaching the second operating position of the magazine, the high-pressure piston can again be coupled to the drive piston to continue the compression of the working medium.

In this embodiment, it is favourable if during movement of the drive piston and the high-pressure piston away from one another using a magnet element, the high-pressure piston is arranged immovably in the direction of the central axis.

In a second embodiment, the following steps are carried out for transferring the magazine from the first operating position into the second operating position:

- shifting the magazine together with the high-pressure seal arranged in the receptacle jointly with the second cylinder substantially in the direction of the central axis of the high-pressure piston away from the drive piston from the first operating position into a first intermediate position which releases the high-pressure seal from the high-pressure piston;
- transferring the magazine from the first intermediate position into a second intermediate position which arranges the replacement high-pressure seal substantially coaxially with the high-pressure piston; and
- shifting the magazine together with the replacement high-pressure seal jointly with the second cylinder substantially in the direction of the central axis of the high-pressure piston towards the drive piston from the second intermediate position into the second operating position.

In the first operating position the high-pressure seal sits sealingly on the high-pressure piston. In order to free the high-pressure seal from the high-pressure piston, the magazine together with the second cylinder can be shifted axially in one direction into the first intermediate position in which the sealing contact between the high-pressure piston and the high-pressure seal is released. Preferably the high-pressure seal on the magazine in the first intermediate position is pushed beyond one end of the high-pressure piston in the axial direction so that the high-pressure seal is arranged outside the high-pressure piston in the axial direction. The magazine can then be brought into the second intermediate position with which the arrangement of the replacement high-pressure seal is prepared. Finally the magazine together with the second cylinder can be shifted axially in the other direction in order to arrange the replacement high-pressure seal at the magazine sealingly on the high-pressure piston.

In a third embodiment, the following steps are carried out for transferring the magazine from the first operating position into the second operating position:

shifting the high-pressure piston substantially in the direction of the central axis of the high-pressure piston away from the magazine together with the high-pressure seal arranged in the receptacle until the high-pressure seal is released from the high-pressure piston so that the magazine is arranged in a first intermediate position;

transferring the magazine from the first intermediate position into a second intermediate position which arranges the replacement high-pressure seal substantially coaxially with the high-pressure piston; and shifting the high-pressure piston substantially in the direction of the central axis of the high-pressure piston towards the magazine until the replacement high-pressure seal is arranged on the high-pressure piston.

In this embodiment the magazine and the second cylinder for the high-pressure piston can be arranged immovably when changing the high-pressure seal. Instead, the high-pressure piston can be pushed out from the high-pressure seal on the magazine so that the movement of the magazine into the second intermediate position is released. For this purpose a shifting of the high-pressure piston out via the first or second end position can be provided. Advantageously this is made possible by the pressure in a pressure chamber on the side of the drive piston facing away from the high-pressure piston being lowered compared with the first operating position. After exchanging the replacement high-pressure seal, the pressure in the pressure chamber can be increased again to the level of the first operating position so that the movement of the drive piston in the second operating position is restricted to the first and second end position.

Preferably the pressure chamber is formed between a first piston element of the drive piston and a second piston element of the drive piston. The first and the second piston element can be connected to one another via a connecting element, in particular a connecting rod by means of which a maximum distance between the first piston element and the second piston element is provided in the first or second operating position and a minimum distance between the first and second piston element is provided in the first intermediate position.

In a fourth embodiment the following steps are carried out for transferring the magazine from the first operating position into the second operating position:

shifting the high-pressure seal from a position arranged outside the receptacle when viewed in the direction of the central axis of the high-pressure piston into a position arranged in the receptacle, wherein the replacement high-pressure seal is arranged in a further receptacle of the magazine, so that the magazine is arranged in a first intermediate position;

transferring the magazine from the first intermediate position into a second intermediate position which arranges the replacement high-pressure seal substantially coaxially with the high-pressure piston; and shifting the replacement high-pressure seal from the position arranged in the further receptacle of the magazine into a position arranged outside the further receptacle of the magazine when viewed in the direction of the central axis of the high-pressure piston.

In the previously described first, second and third embodiment, the high-pressure seal in the first and second operating position is in each case arranged inside the receptacle on the magazine during compression of the working medium. In the fourth embodiment, the receptacle on the magazine in the first operating position is free from the high-pressure seal. In the second operating position, the further receptacle is free from the replacement high-pressure seal. Accordingly, in the first operating position the high-pressure seal is located outside the receptacle of the magazine when viewed in the axial direction. In the second operating position the replacement high-pressure seal is located outside the further receptacle of the magazine when viewed in the axial direction. When exchanging the high-pressure seal, the high-pressure seal can be initially received in the receptacle on the magazine before the magazine together with the replacement high-pressure seal is moved into the second intermediate position for exchanging the replacement high-pressure seal. Finally, the replacement high-pressure seal is pressed out from the further receptacle in order to arrange the replacement high-pressure seal in the second operating position. During operation of the compressor therefore one of the receptacles on the magazine is always empty in order to be able to receive a worn high-pressure seal during the exchange process.

In the fourth embodiment, the high-pressure seal and the replacement high-pressure seal are each shifted jointly with the second cylinder. In this embodiment, it is in particular favourable if the high-pressure seal and the replacement high-pressure seal each have substantially the same inside and outside diameter as the second cylinder. Preferably the high-pressure seal in the first operating position is arranged adjacent to an axial end region of the second cylinder. In the second operating position on the other hand, the replacement high-pressure seal is arranged adjacent to the axial end region of the second cylinder. It is further preferred if the high-pressure seal, when viewed in the axial direction, is arranged between the second cylinder and a pressure part. The pressure part is mounted displaceably in the axial direction by means of the changeover device. For shifting the high-pressure seal from outside the receptacle into the receptacle, the pressure part is displaced axially in one direction by means of the changeover device so that the high-pressure seal is shifted together with the second cylinder. Accordingly the second cylinder is shifted in the other direction in order to shift the replacement high-pressure seal from the further receptacle. In this case, the pressure part is entrained. The shifting of the pressure part in one direction or the shifting of the second cylinder in the other direction is brought about by means of the drive, for example, a pneumatic drive of the changeover device.

In each of the previously explained embodiments, for transfer from the first intermediate position into the second intermediate position, the magazine can be pivoted about a pivot axis running substantially parallel to the central axis of the high-pressure piston on the one hand or on the other hand can be shifted substantially in the direction perpendicular to the central axis of the high-pressure piston.

According to a preferred embodiment, a sensor device for detecting a leakage of the working medium is provided. The sensor device can be configured according to the prior art. For example, an increase in pressure can be established in a normally pressure-less leakage line in conjunction with the high-pressure seal. Furthermore, a gas measurement can be made in the leakage line.

Preferably, a control device is connected to the sensor device on the one hand and to the changeover device on the other hand, in order to transfer the magazine from the first operating position into the second operating position upon detecting a leakage of the working medium.

In a first preferred embodiment, the changeover device for transferring the magazine from the first operating position into a second operating position is adapted to shift the magazine together with the high-pressure seal arranged in the receptacle substantially in the direction of the central axis of the high-pressure piston relative to the second cylinder.

In the first embodiment, a clamping device is preferably provided for detachable coupling of the high-pressure piston to the drive piston. In the coupled state the high-pressure piston moves together with the drive piston. In the released state the high-pressure piston is decoupled from the movement of the drive piston. In other embodiments the drive piston and the high-pressure piston can be fixedly coupled to one another.

In order to create space for exchanging the high-pressure seal in this variant, it is favourable if the high-pressure piston in the first intermediate position of the magazine is arranged in the state released and spaced apart from the drive piston. It is particularly preferred if in the first intermediate position of the magazine, the high-pressure piston is arranged in the first end position and the drive piston is arranged in the second end position moved away therefrom. In this embodiment, the high-pressure piston and the drive piston in the first intermediate position are at a maximum distance from one another so that sufficient space is provided for exposing the high-pressure seal. In order to be able to arrange the high-pressure piston at a distance from the drive piston in preparation for the seal change, it is preferable to provide a magnet element for fixing the high-pressure piston in the state released from the drive piston in the first end position.

In a second preferred embodiment, for transferring the magazine from the first operating position into a first intermediate position, the changeover device is adapted to shift the magazine together with the second cylinder substantially in the direction of the central axis of the high-pressure piston.

In a third preferred embodiment, for transferring the magazine from the first operating position into a first intermediate position, the changeover device is adapted to shift the high-pressure piston substantially in the direction of the central axis of the high-pressure piston beyond the first or second end position.

In a fourth preferred embodiment, for transferring the magazine from the first operating position into a first intermediate position, the changeover device is adapted to shift the second cylinder substantially in the direction of the central axis of the high-pressure piston in order to bring the high-pressure seal from a position arranged axially outside the receptacle into a position arranged in the receptacle.

Furthermore, the changeover device is preferably adapted for transferring the magazine from the first intermediate position into a second intermediate position which arranges the replacement high-pressure seal substantially coaxially with the high-pressure piston. Accordingly the central axes of the replacement high-pressure seal and the high-pressure piston in the second intermediate position are aligned substantially collinearly. The replacement high-pressure seal is located in the second intermediate position when viewed in the axial direction, outside the high-pressure piston. As a result of an axial relative movement between replacement high-pressure seal and high-pressure seal, the second operating position can be reached in which the high-pressure piston is sealed by the replacement high-pressure seal.

In the above-described first preferred embodiment, the changeover device for transferring the magazine from the second intermediate position into the second operating position is preferably adapted to shift the magazine together with the replacement high-pressure seal arranged in the receptacle substantially in the direction of the central axis of the high-pressure piston relative to the second cylinder.

In the above-described second preferred embodiment, the changeover device for transferring the magazine from the second intermediate position into the second operating position is preferably adapted to shift the magazine together with the second cylinder substantially in the direction of the central axis of the high-pressure piston.

In the above-described third preferred embodiment, the changeover device for transferring the magazine from the second intermediate position into the second operating position is preferably adapted to shift the high-pressure piston substantially in the direction of the central axis of the high-pressure piston back into the first or second end position.

In the above-described fourth preferred embodiment, the changeover device for transferring the magazine from the second intermediate position into the second operating position is preferably adapted to shift the second cylinder substantially in the direction of the central axis of the high-pressure piston in order to bring the replacement high-pressure seal from a position arranged in a further receptacle of the magazine into a position arranged axially outside the further receptacle.

According to a preferred embodiment, a gaseous working medium, in particular molecular hydrogen is compressed.

According to a preferred embodiment, the drive piston is operated with a preferably gaseous drive medium, different from the working medium, in particular air.

In order to move the high-pressure seal away from the high-pressure piston and instead arrange the replacement high-pressure seal adjacent to the high-pressure piston, in a preferred embodiment the changeover device is adapted for pivoting the magazine about a pivot axis running substantially parallel to the central axis of the high-pressure piston between the first intermediate position and the second intermediate position. In this embodiment, the magazine can be pivoted in such a manner that the replacement high-pressure seal is brought from a waiting position remote from the high-pressure piston into a position arranged collinearly with the high-pressure piston.

In a further preferred embodiment, the changeover device is adapted for shifting the magazine substantially in the direction perpendicular to the central axis of the high-pressure piston between the first intermediate position and the second intermediate position. In this embodiment the magazine is displaceably substantially in the radial direction in order to bring the replacement high-pressure seal from the waiting position remote from the high-pressure piston into the position arranged coaxially with the high-pressure piston.

According to a preferred embodiment, the high-pressure seal and the replacement high-pressure seal each have a housing in which at least one sealing element is arranged, in particular detachably. This design facilitates the arrangement of unused sealing elements in the magazine as soon as the sealing elements of the high-pressure seal and the replacement high-pressure seal are worn. The sealing element is preferably configured circumferentially and extends over the complete circumference of the high-pressure piston.

According to a preferred embodiment, the high-pressure seal and the replacement high-pressure seal each have a first sealing element for sealing a high-pressure side and a second sealing element for sealing a low-pressure side. The first sealing element is located on the side of the high-pressure piston, the second sealing element is located on the side of the drive or low-pressure piston.

Furthermore it is favourable if the high-pressure seal and the replacement high-pressure seal each have a bearing element, in particular a guide band, a radial plain bearing or a recirculating ball bearing for mounting the high-pressure piston. The bearing element preferably extends over the complete circumference of the high-pressure piston.

In order to enable long operating times of the compressor without maintenance intervals, the magazine preferably has a plurality of replacement high-pressure seals wherein preferably between 2 and 7 replacement high-pressure seals are provided.

The drive for transferring the magazine between the first operating position and the second operating position preferably comprises at least one in particular electric, hydraulic or pneumatic linear and/or rotary drive depending on the design.

The previously explained magazine with the changeover device can be used in different types of compressor.

In a preferred embodiment a single-acting drive piston is provided.

A further preferred embodiment is characterized by

- a further high-pressure piston on the side of the drive piston facing away from the high-pressure piston;
- a further magazine with a receiving element for a further high-pressure seal for sealing the further high-pressure piston in a first operating state of the further magazine and with at least one further replacement high-pressure seal for sealing the further high-pressure piston in a second operating state of the further magazine;
- a further changeover device for transferring the further magazine between the first operating position and the second operating position.

In this embodiment, a double-acting drive piston is therefore provided. The high-pressure piston and the further high-pressure piston can be operated in parallel or as stages. Exchanging the further high-pressure seal and exchanging the further replacement high-pressure seal can be accomplished as in the above-described embodiments so that repetitions can be dispensed with.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

The accompanying drawings are incorporated herein as part of the specification. The drawings described herein illustrate embodiments of the presently disclosed subject matter, and are illustrative of selected principles and teachings of the present disclosure. However, the drawings do not illustrate all possible implementations of the presently disclosed subject matter, and are not intended to limit the scope of the present disclosure in any way.

FIGS. 8 to 12 each show a second embodiment of the compressor according to the invention with a magazine which is displaceable in the axial and radial direction, wherein FIG. 8 shows the first operating position, FIG. 9 shows the first intermediate position, FIG. 10 shows a state between the first and second intermediate position, FIG. 11 shows the second intermediate position and FIG. 12 shows the transfer into the second operating position.

FIG. 13) and a first intermediate position (cf. FIG. 14).

FIG. 15) is arranged outside a receptacle of the magazine and is pushed into the receptacle by means of the second cylinder (cf. FIG. 16).

DETAILED DESCRIPTION

Figure 1:
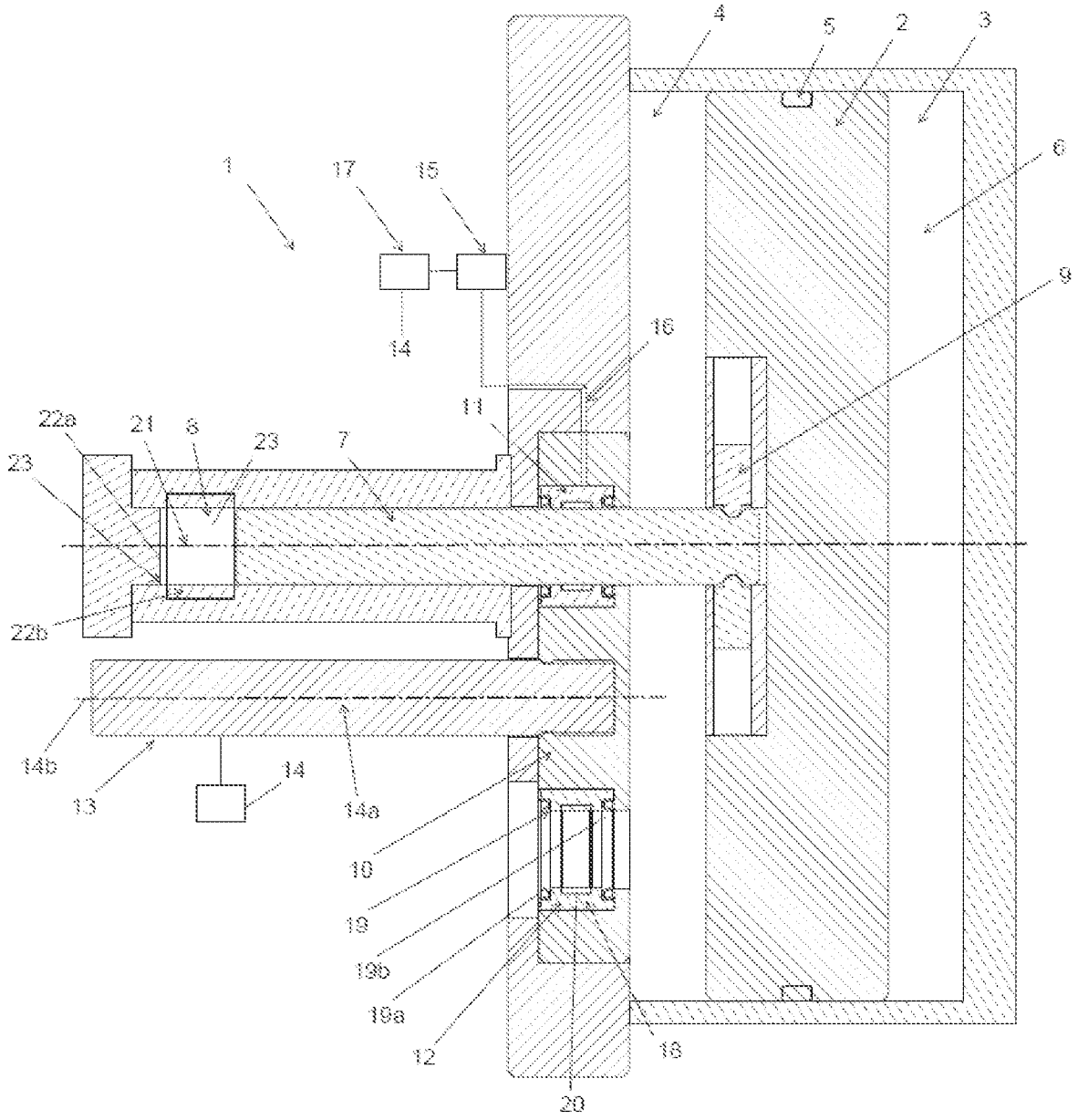
FIG. 1 shows a first embodiment of a compressor according to the invention with a drive piston and a high-pressure piston in a middle position, wherein a magazine with a high-pressure seal and a replacement high-pressure seal are arranged in a first operating position.

It is to be understood that the invention may assume various alternative orientations and step sequences, except where expressly specified to the contrary. It is also to be understood that the specific assemblies and systems illustrated in the attached drawings, and described in the following specification are simply exemplary embodiments of the inventive concepts defined herein. Hence, specific dimensions, directions or other physical characteristics relating to the embodiments disclosed are not to be considered as limiting, unless expressly stated otherwise. Also, although they may not be, like elements in various embodiments described herein may be commonly referred to with like reference numerals within this section of the application.

FIGS. 1 to 7 show a first embodiment of a compressor 1 for compressing a gaseous working medium, for example, molecular hydrogen. The compressor 1 comprises a pressure translator with a drive piston 2, which is moved back and forth within a first cylinder 3 between a first end position (cf. FIG. 2) and a second end position (not shown). A gaseous drive medium, in particular compressed air, is used for the drive of the drive piston 2. The drive piston 2 seals a first volume 4 of the first cylinder 3 by means of a seal 5 with respect to a second volume 6 of the first cylinder 3. Further provided is a high-pressure piston 7 which compresses the working medium, which is moved back and forth within a second cylinder 8 between a first end position (cf. FIG. 2) and a second end position (not shown). The high-pressure piston 7 has a smaller piston area than the drive or low-pressure piston 2 so that a pressure translation from the low-pressure to the high-pressure side is achieved. For coupling the high-pressure piston 7 to the drive piston 2, a detachable clamping device 9 is provided in the first embodiment. This clamping device 9 is known per se so that more detailed explanations can be superfluous. In other embodiments, see FIGS. 8 to 16, the high-pressure piston 7 can be fixedly connected to the drive piston 2 in order to transmit the movement of the drive piston 2 to the high-pressure piston 7.

The compressor 1 additionally comprises a magazine 10 which is equipped with a receptacle 11*a* for a high-pressure seal 11 and with at least one further receptacle 12*a* for a replacement high-pressure seal 12. The high-pressure seal 11 brings about the sealing of the high-pressure piston 7 in a first operating position during compression of the working medium. The replacement high-pressure seal 12 brings about the sealing of the high-pressure piston 7 in a second operating position of the magazine 10 which is different from this, during compression of the working medium. Furthermore, a changeover device 13 is provided for independent exchange of the high-pressure seal 11 by the replacement high-pressure seal 11. The changeover device 13 has a drive 14 (only shown schematically in FIG. 1) by means of which—as will be explained in detail hereinafter, the magazine 10 can be moved from the first operating position into the second operating position (and conversely).

As is further apparent schematically from FIG. 1, a sensor device 15 is provided for detecting a leakage of the working medium. The sensor device 15 is connected to a leakage line 16 at which escaping working medium (possibly also escaping drive medium) can be detected. The sensor device 15 can—as is known per se in the prior art—have a pressure measuring element for detecting the gas pressure in the leakage line 16. Additionally or alternatively, the sensor device 15 can be adapted for qualitative or quantitative gas measurement. A plurality of possibilities are known for this in the prior art, based on electrical, physical and/or chemical measurement principles so that this need not be discussed in detail. In addition, the compressor 1 has an electronic control device 17 which on the one hand is connected to the sensor device 15 and on the other hand is connected to the changeover device 13. If a leakage of the working medium is detected at the sensor device 15, the drive 14 of the changeover device 13 is actuated by the control device 17 in such a manner that the magazine 10 is moved from the first operating position into the second operating position in order to arrange the replacement high-pressure seal 12 on the high-pressure piston 7.

In the embodiment shown the high-pressure seal 11 and the replacement high-pressure seal 12 each have a housing 18 in which at least one annularly circumferential sealing element 19 is arranged in a reversibly detachable manner. In the embodiment shown the high-pressure seal 11 and the replacement high-pressure seal 12 each have a first annularly circumferential sealing element 19*a* for sealing a high-pressure side and a second annularly circumferential sealing element 19*b* for sealing a low-pressure side of the compressor 1. Furthermore, in the embodiment shown the high-pressure seal 11 and the replacement high-pressure seal 12 each have an annularly circumferential bearing element 20, in the embodiment shown a guide band, for mounting the high-pressure piston 7.

Depending on the design, the magazine 10 can have a plurality of replacement high-pressure seals 12. In many cases it is favourable if between 2 and 7 replacement high-pressure seals 12 are provided on the magazine 10.

Only the essential components of the compressor for the understanding of the invention are shown in the drawing. For the person skilled in the art it is clear that the compressor can typically have numerous further components which, however, are sufficiently known in the prior art.

In the first embodiment of FIGS. 1 to 7, the magazine 10 is displaceable on the one hand in the direction of a central axis 21 of the high-pressure piston and on the other hand, is pivotable about a pivot axis running parallel and at a distance thereto. For this purpose, the drive 14 of the changeover device 13 according to FIGS. 1 to 7 has a drive rod 14*a* which can be displaced in the longitudinal direction and which can be pivoted about its own longitudinal axis 14*b*.

FIGS. 1 to 7 illustrate the individual steps on changing from the first operating position using the high-pressure seal 11 into the second operating position using the replacement high-pressure seal 12.

Figure 2:
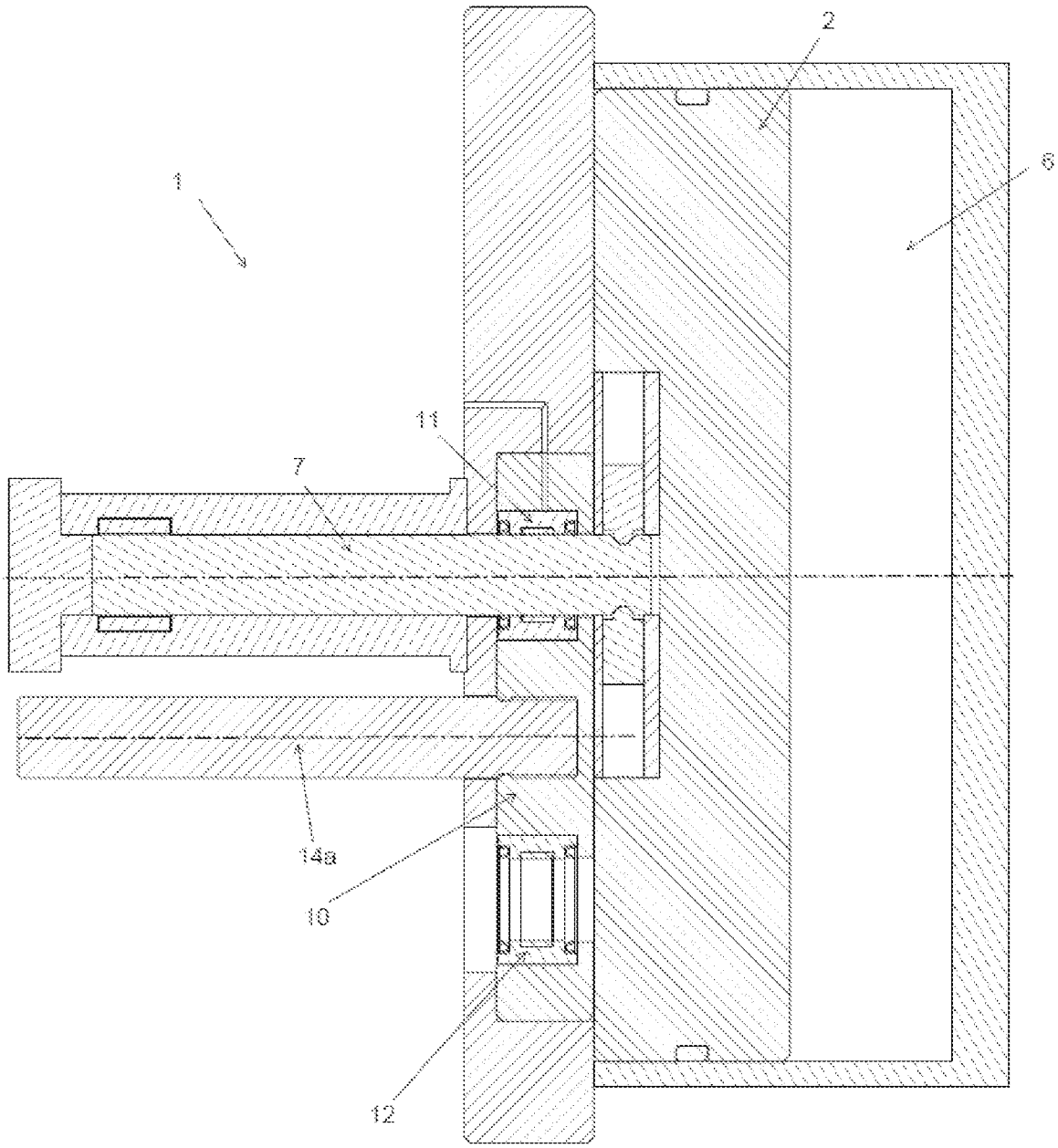
FIG. 2 shows the compressor according to FIG. 1 wherein drive piston and high-pressure piston are arranged in the other end position.

According to FIG. 1 and FIG. 2, the magazine 1 is arranged in the first operating position in which the high-pressure piston 7 is sealed by the high-pressure seal 11. The high-pressure piston 7 is coupled via the clamping device 9 to the drive piston 2 so that the high-pressure piston 7 and drive piston 2 can move synchronously back and forth. FIG. 1 shows drive piston 2 and high-pressure piston 7 each in a central position between the opposite dead points. FIG. 2 shows the drive piston 2 in the first end position and the high-pressure piston 7 in the first end position.

Figure 3:
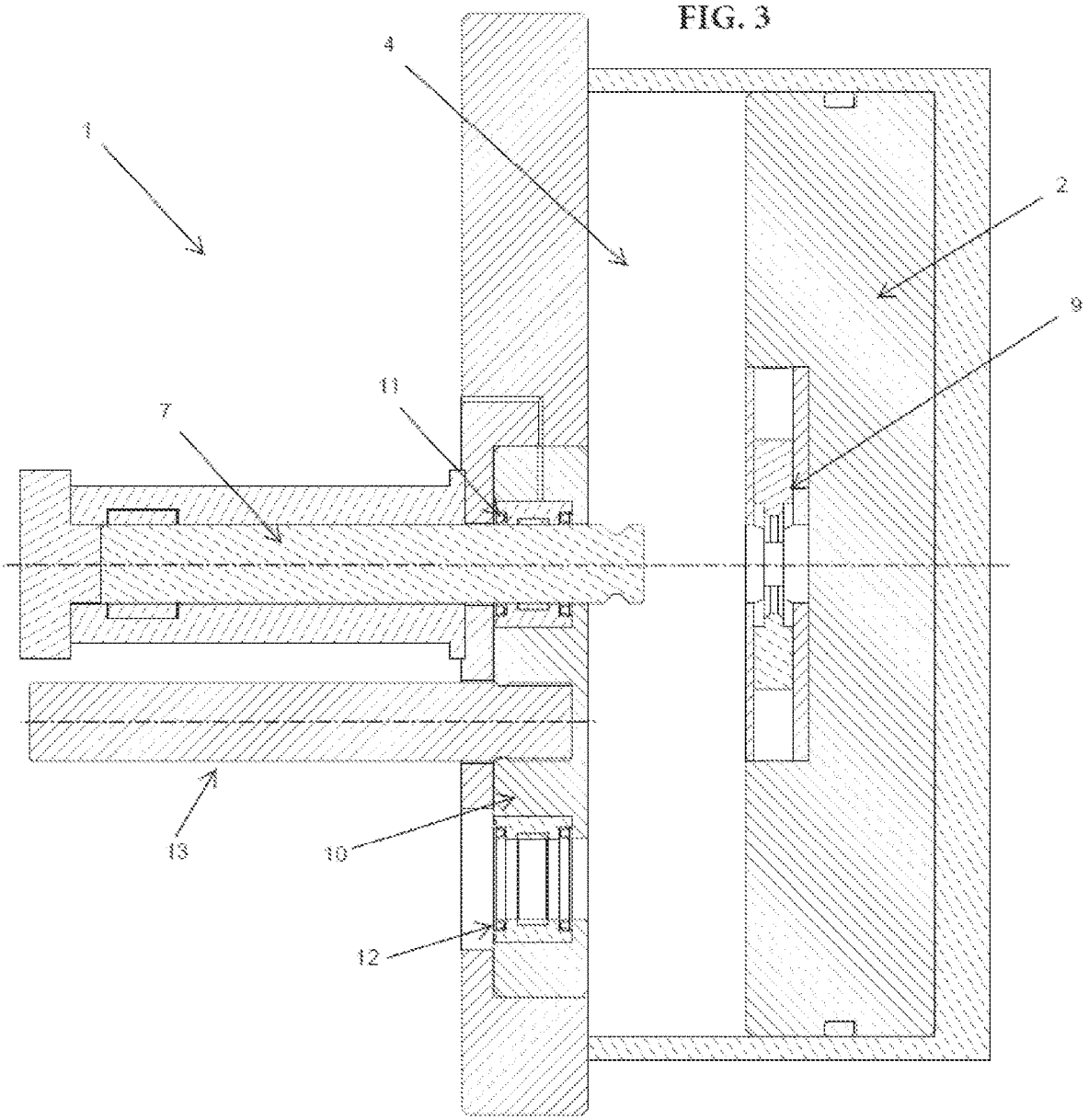
FIG. 3 shows the compressor according to FIGS. 1, 2 wherein after releasing a clamping device the drive piston is moved away from the high-pressure piston so that a free space is formed between drive piston and high-pressure piston.

According to FIG. 3, the clamping device 9 is in the released state wherein the high-pressure piston 7 is decoupled from the drive piston 2. The high-pressure piston 7 is arranged on the first end position and the drive piston 2 is arranged in the second end position so that a maximum distance in the axial direction is achieved between high-pressure piston 7 and drive piston 2. In order to reach this state, a magnet element can be provided which holds the high-pressure piston 7 firmly in the first end position released from the drive piston 2. A permanent magnet 22*a* or a magnetic coil 22*b* can be provided as magnet element. In the embodiment shown, the magnetic coil 22*b* is arranged concentrically about the high-pressure piston 7 on the second cylinder 8. Furthermore, the rest position of the high-pressure piston 7 can be achieved by a pressure difference between the first volume 4 of the first cylinder 3 and a high-pressure volume 23 of the second cylinder 8. This is achieved by relieving the pressure of the high-pressure volume 23, wherein the first volume 4 remains pressurized. The resulting force presses the high-pressure piston 7 into the first end position.

Figure 4:
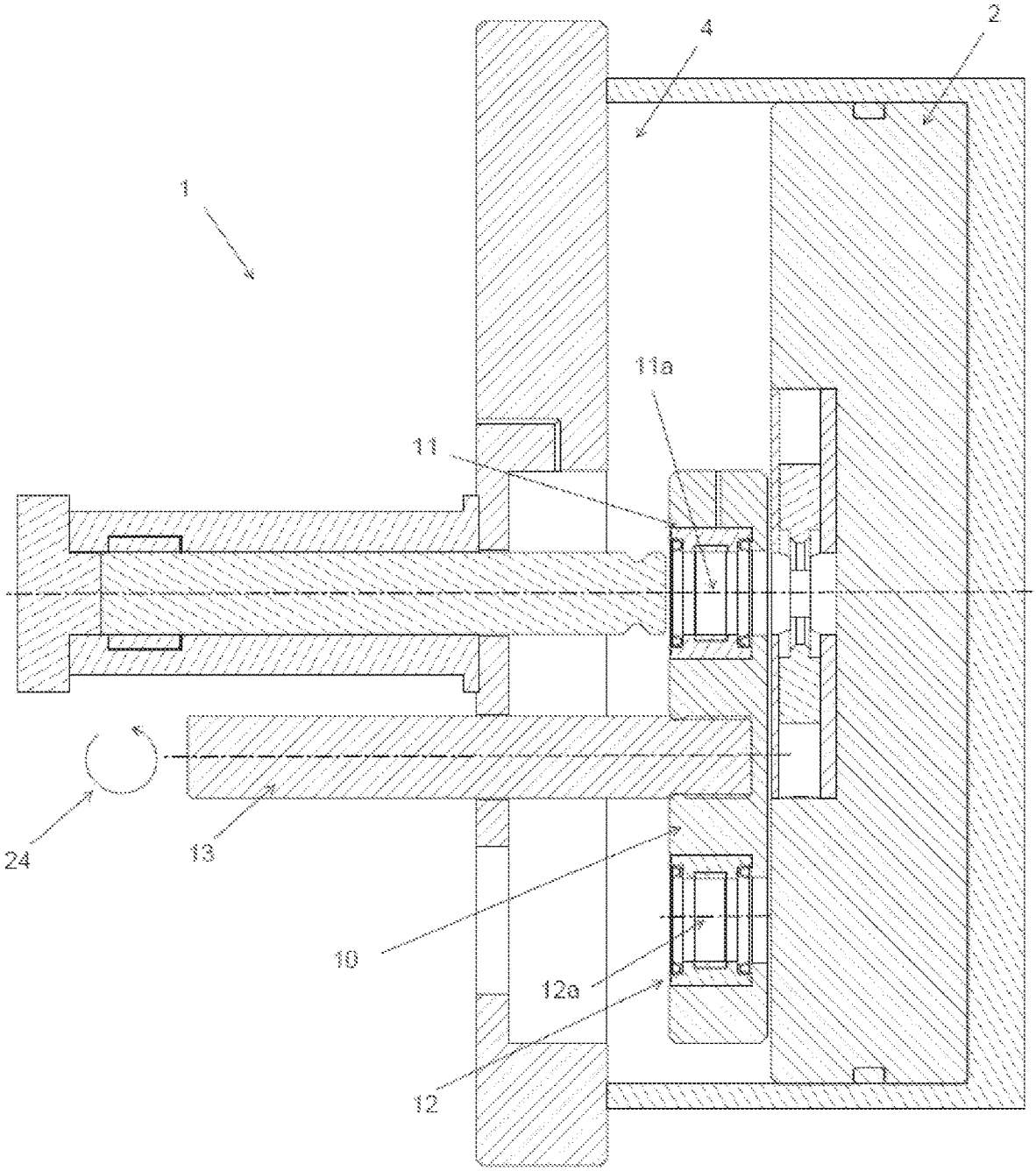
FIG. 4 shows the compressor according to FIGS. 1 to 3 in a first intermediate position of the magazine, in which the high-pressure seal is shifted into the free space between drive piston and high-pressure piston.

According to FIG. 4, the magazine 10 is arranged in a first intermediate position displaced axially towards the drive piston 2. Since the high-pressure piston 7 and the drive piston 2 are arranged in opposite end positions, the high-pressure seal 11 is located on the magazine 10 when viewed in the axial direction between the end of the high-pressure piston 7 released from the drive piston 2 and the drive piston 2. The central axis 11*a* of the high-pressure seal 11 is arranged collinearly to the central axis 21 of the high-pressure piston 7. The central axis 12*a* of the replacement high-pressure seal 12 is arranged parallel to and in the radial direction at a distance from the central axis 21 of the high-pressure piston 7.

Figure 5:
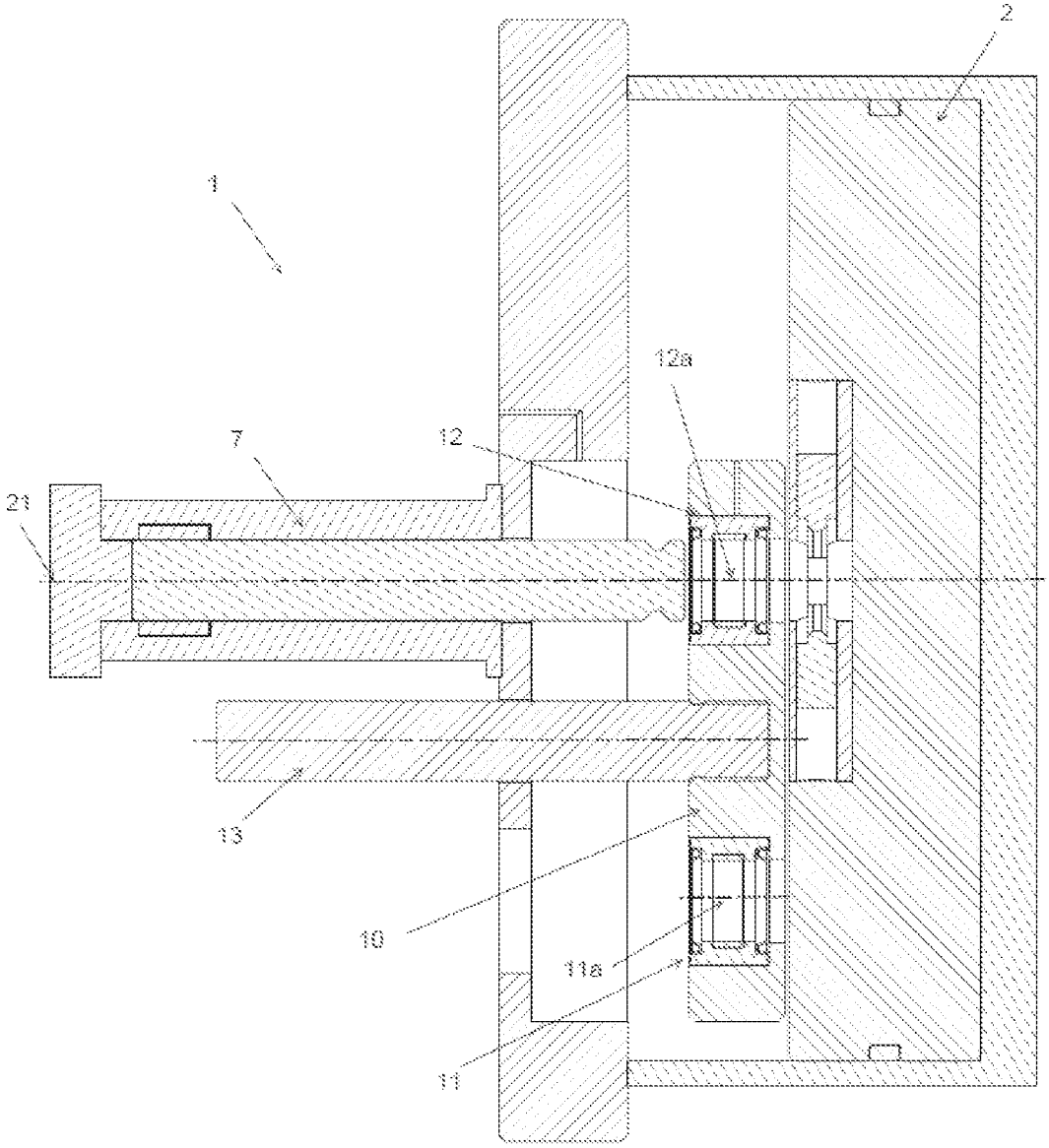
FIG. 5 shows the compressor according to FIGS. 1 to 4 in a changeover position after pivoting the magazine from the first intermediate position, wherein the replacement high-pressure seal is arranged adjacent to the high-pressure piston.

According to FIG. 5, the magazine 10 is in a first intermediate position in which the central axis 12*a* of the replacement high-pressure seal 12 is arranged substantially collinearly with the central axis 21 of the high-pressure piston 7. The central axis 11*a* of the high-pressure seal 11 is now arranged parallel to and in the radial direction at a distance from the central axis 21 of the high-pressure piston 7. In order to reach the changeover position, starting from the first intermediate position, the magazine 10 is pivoted about the pivot axis 14*b* (cf. arrow 24 in FIG. 4). The pivot angle depends on the number and the arrangement of the replacement high-pressure seals 12 on the magazine 10.

Figure 6:
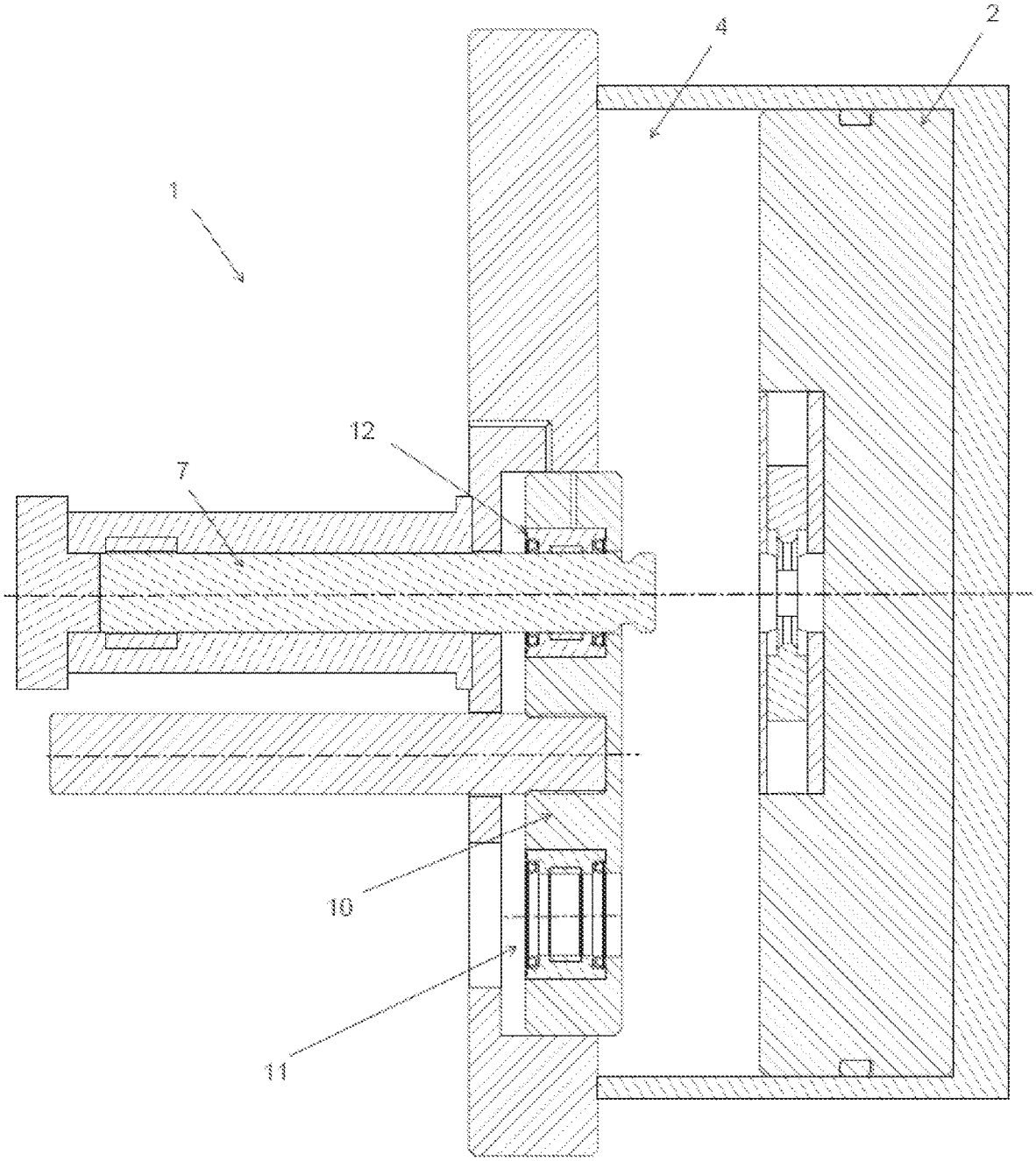
FIG. 6 shows the compressor according to FIGS. 1 to 5, wherein the replacement high-pressure seal is pushed onto the high-pressure piston.

According to FIG. 6, the replacement high-pressure seal 12 is pushed onto the high-pressure piston 7. For this purpose, starting from the first intermediate position (cf. FIG. 5), the magazine 10 is displaced in the axial direction away from the drive piston 2 until the replacement high-pressure seal 12 sits on the high-pressure piston 7.

Figure 7:
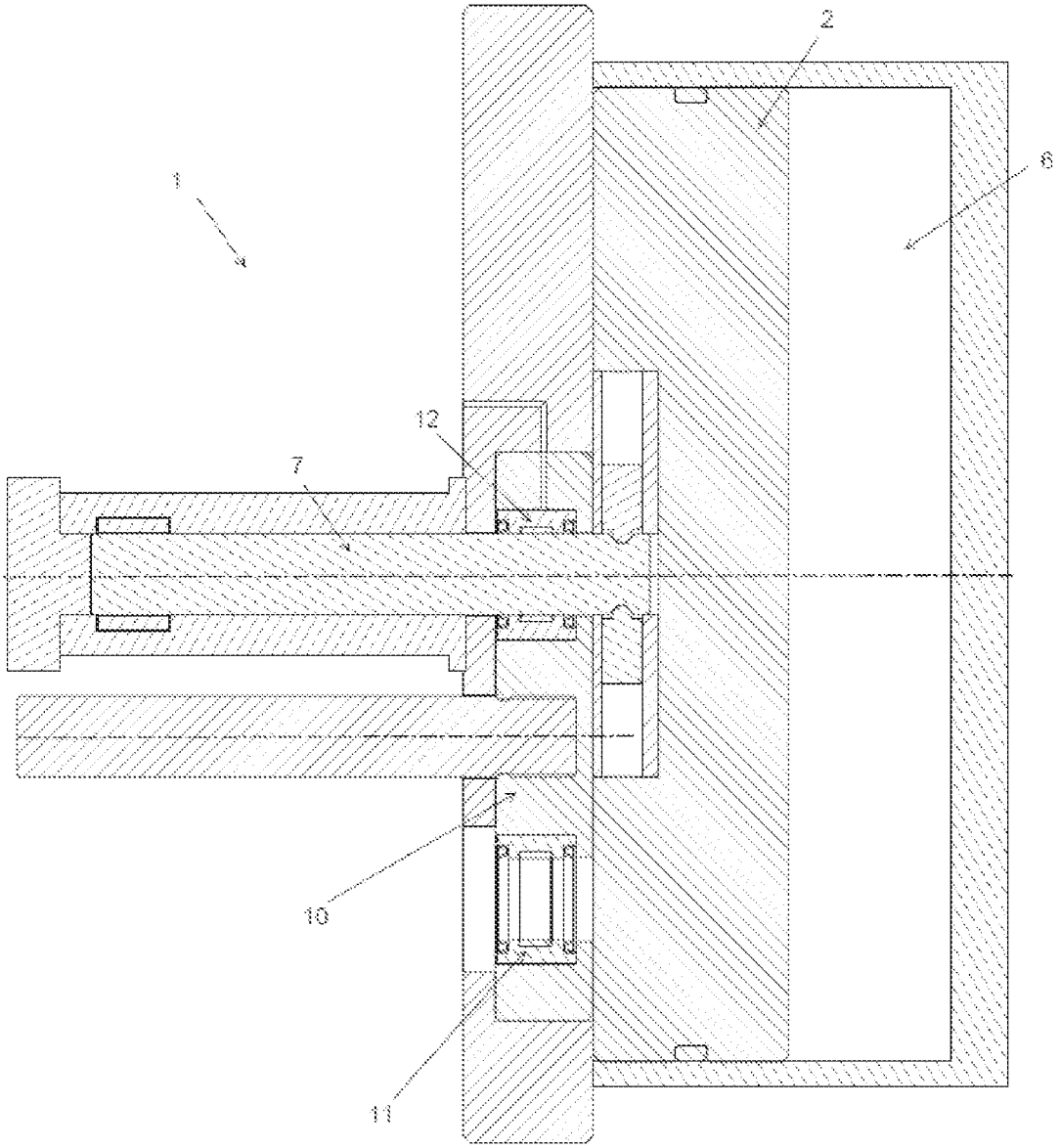
FIG. 7 shows the compressor according to FIGS. 1 to 6 in the second operating position wherein the high-pressure piston is again coupled to the drive piston.

According to FIG. 7, the drive piston 2 is again coupled to the high-pressure piston 7 so that operation of the compressor 1, now with the exchanged replacement high-pressure seal 12, can be continued.

FIGS. 8 to 12 show a further embodiment of the compressor 1, wherein only the differences from the embodiment of FIGS. 1 to 7 will be discussed hereinafter.

Figure 8:
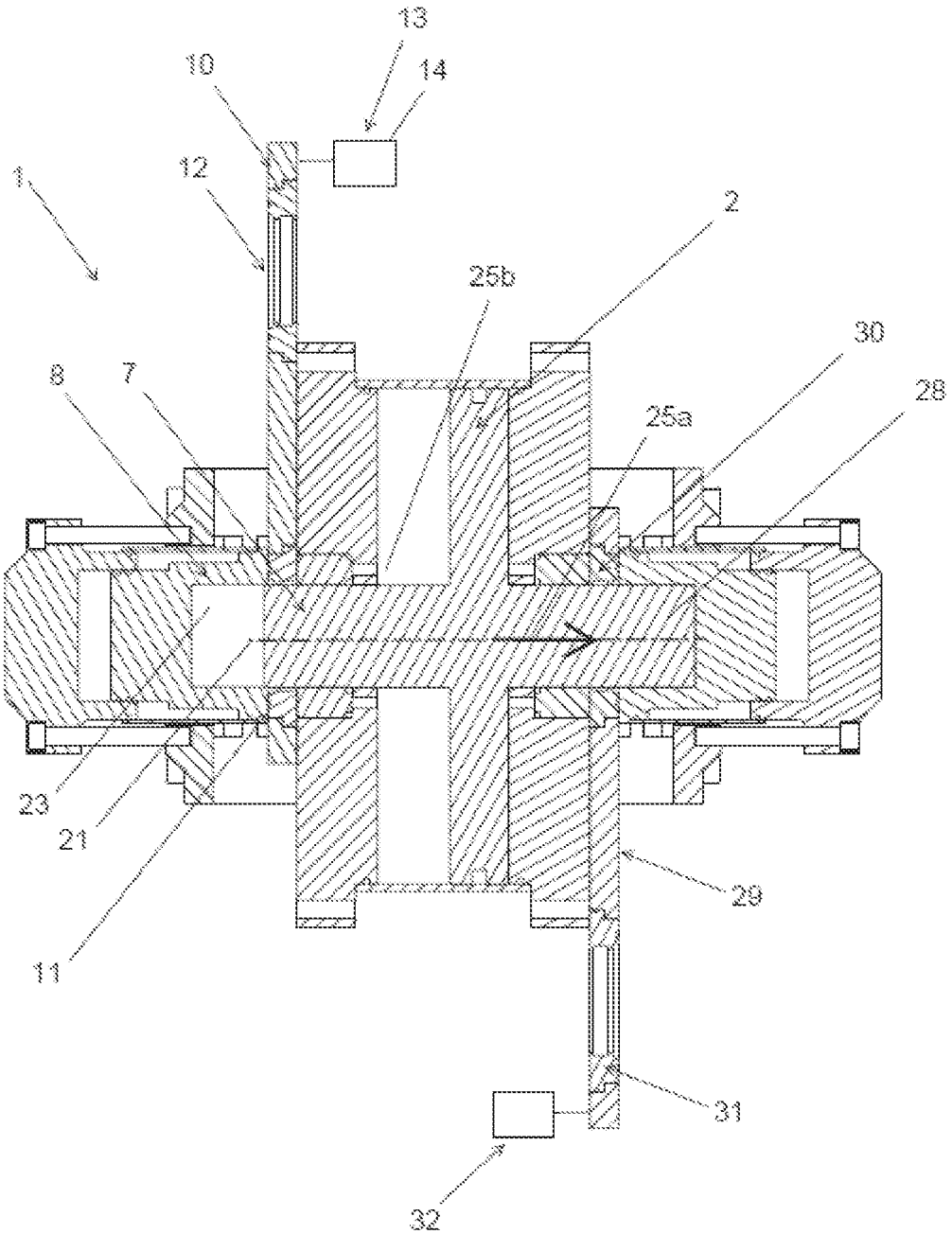
Figure 9:
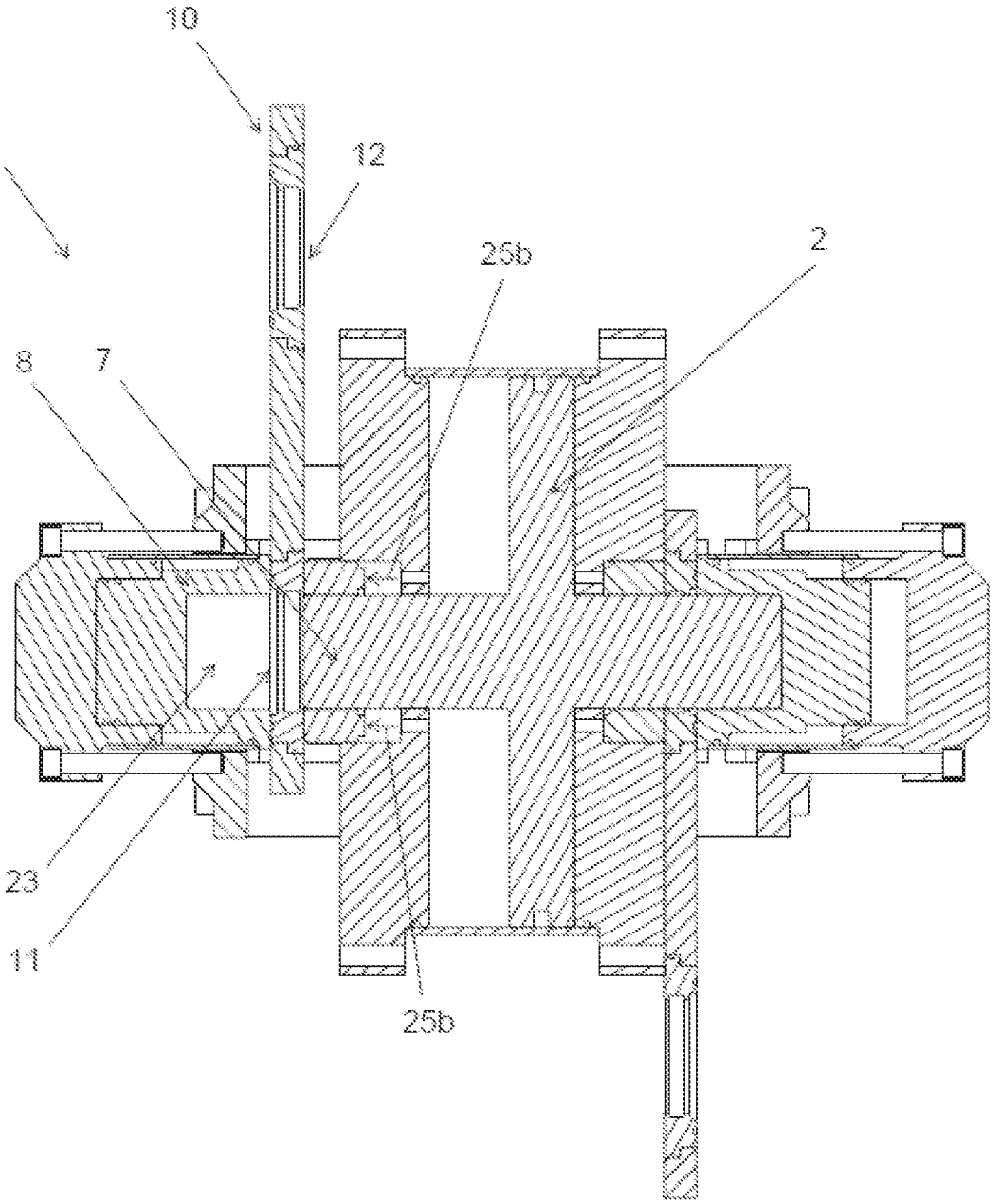

In this embodiment, the magazine 10 together with the second cylinder 8 for the high-pressure piston 7 is displaced from the first operating position (cf. FIG. 8) away from the first cylinder 3 for the drive piston 2 into the first intermediate position (cf. FIG. 9). Thus, the clamping device 9 for the detachable coupling between drive piston 2 and high-pressure piston 7 can be omitted.

Furthermore, this embodiment differs from that of FIGS. 1 to 7 in that the changeover device 13 is adapted for shifting the magazine 10 in the direction perpendicular to the central axis 21 of the high-pressure piston 7, i.e. in the radial direction, from the first intermediate position into the second intermediate position (and conversely).

Thus, the following steps are carried out when changing from the high-pressure seal 11 to the replacement high-pressure seal 12.

According to FIG. 8, the compressor 1 is arranged in the first operating position in which the high-pressure seal 11 on the magazine 10 brings about the sealing of the high-pressure piston 7. The central axis 11*a* of the high-pressure seal 11 coincides with the central axis 21 of the high-pressure piston 21. The replacement high-pressure seal 12 is arranged in a waiting position remote from the high-pressure piston 7 in the radial direction. The drive piston 2 is located in the end position shifted away from the magazine 10 (cf. arrow 25*a*).

According to FIG. 9, the magazine 10 together with the second cylinder 8 is shifted in the axial direction (cf. arrows 25*b*) so that the magazine 10 enters into the first intermediate position. During this the drive piston 2 and the high-pressure piston 7 are arranged in the end position shifted away from the magazine 10. Thus, during displacement of the magazine 10 with the second cylinder 8, the high-pressure seal 11 slips away from the end of the high-pressure piston 7.

Figure 10:
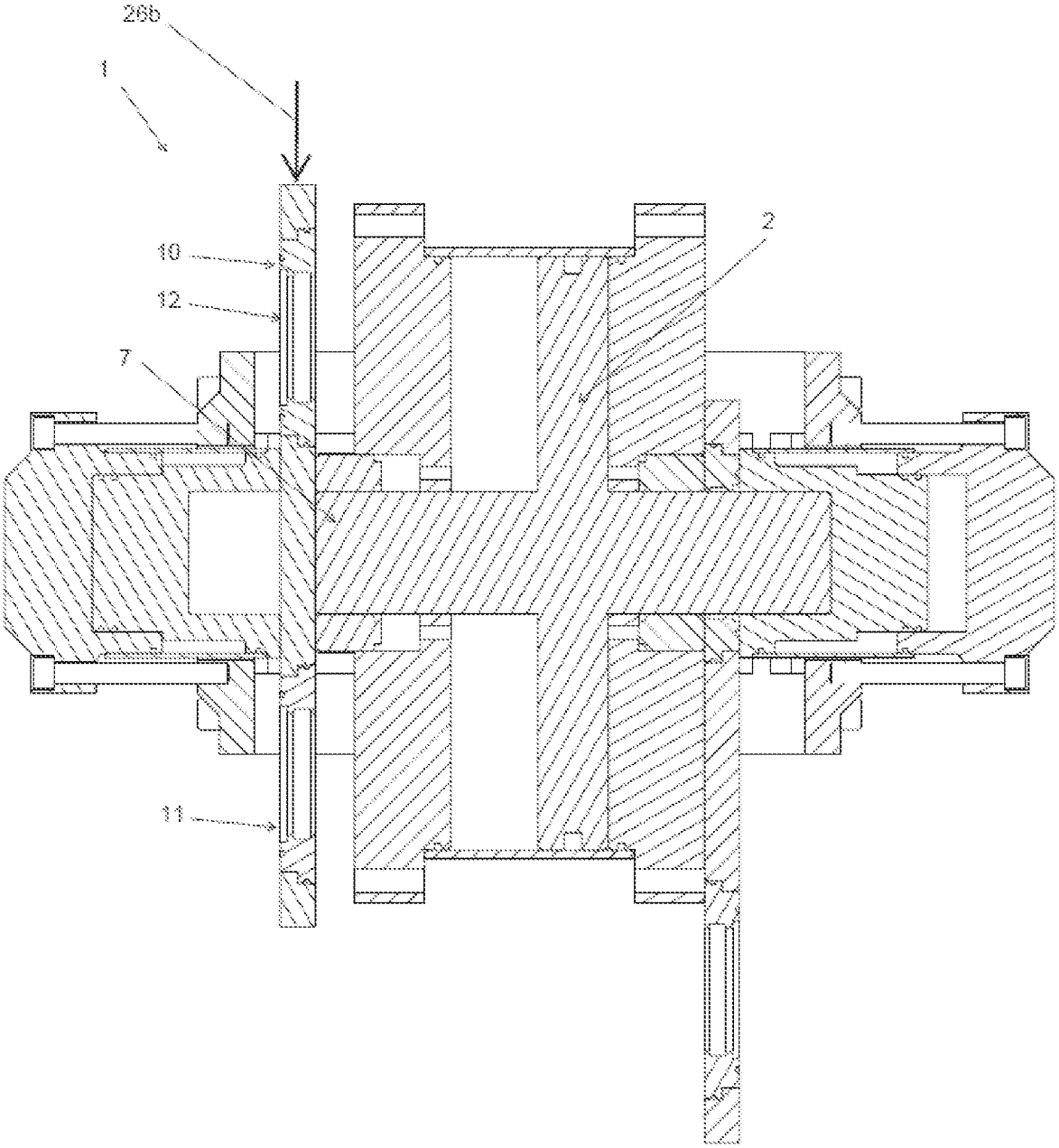

According to FIG. 10, the magazine 10 is shifted relative to the second cylinder 8 in the radial direction (cf. arrow 26*b*).

Figure 11:
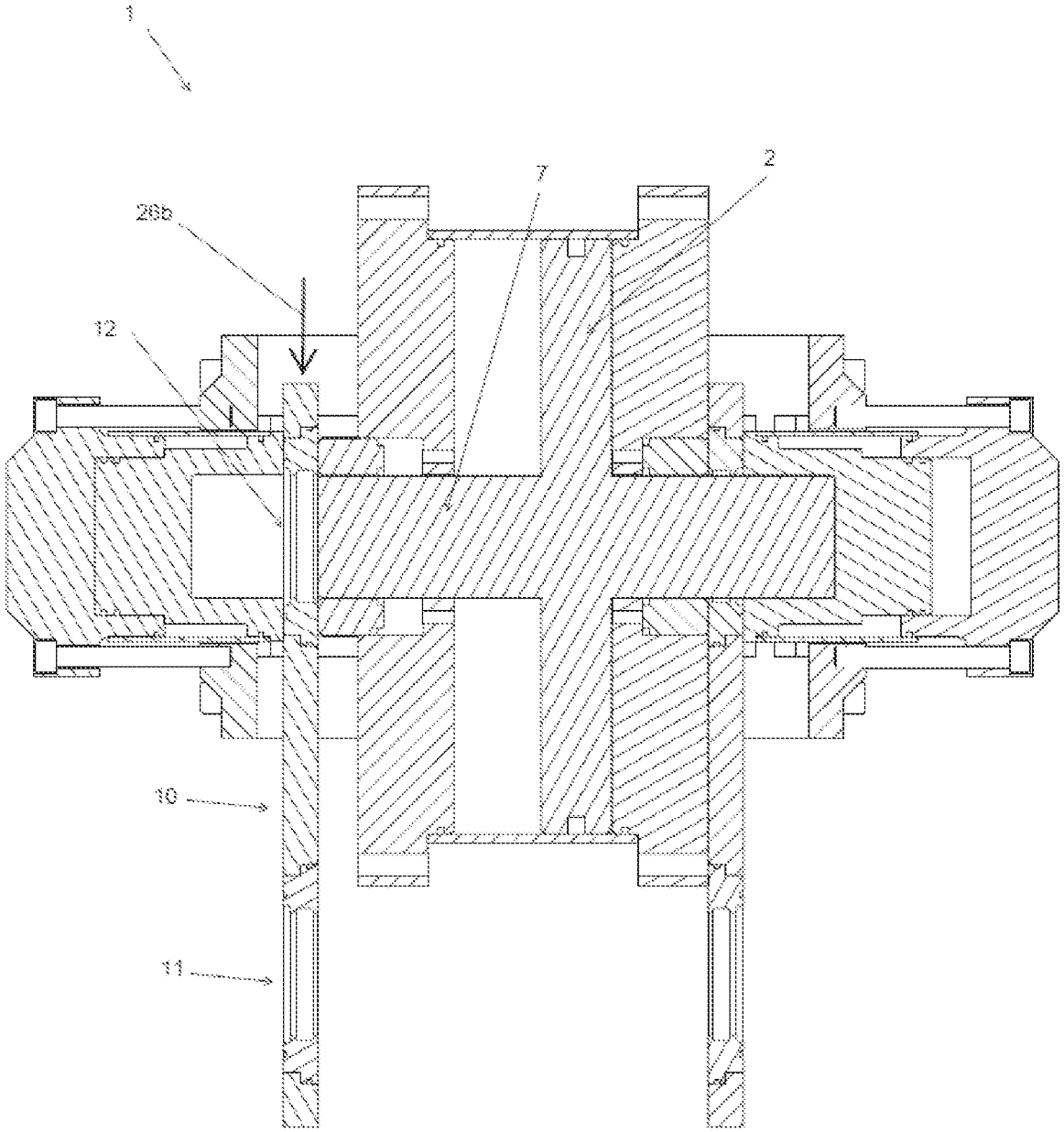

According to FIG. 11, as a result of further shifting in the direction of the arrow 26*b*, the magazine 10 enters into the second intermediate position in which the replacement high-pressure seal 12 on the magazine 10 is arranged collinearly with the high-pressure piston 7 but outside thereof in the axial direction.

Figure 12:
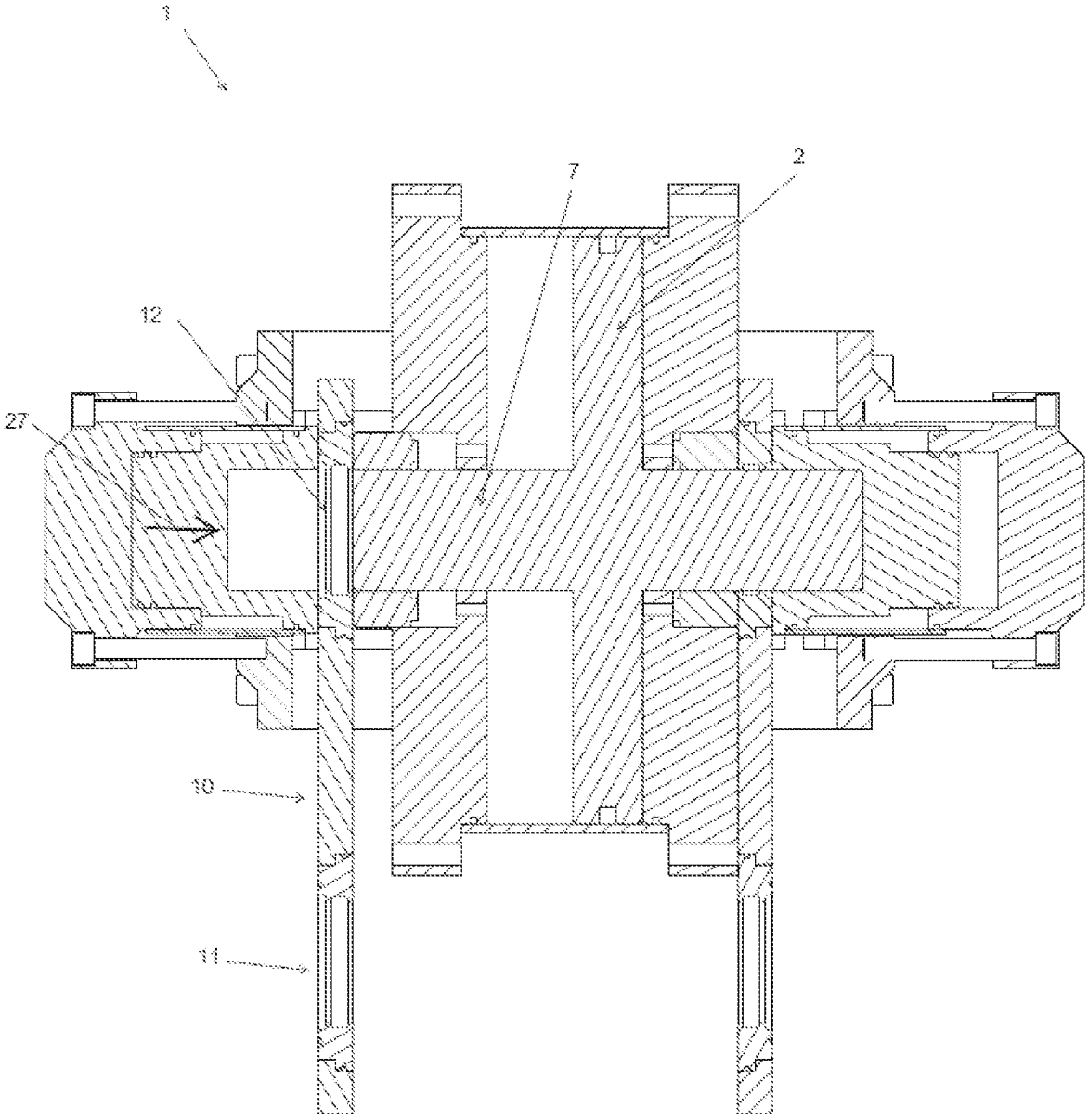

According to FIG. 12, the magazine 10 together with the second cylinder 8 is pushed in the axial direction onto the high-pressure piston 7 (cf. arrow 27) until the second operating position is reached with sealing arrangement of the replacement high-pressure seal 12 on the high-pressure piston 7.

In the embodiment of FIGS. 8 to 12, a double-acting drive piston 2 is provided. In this embodiment the compressor 1 has a further high-pressure piston 28 on the side of the drive piston 2 facing away from the high-pressure piston 7. The drive piston 2 drives both the high-pressure piston 7 and also the further high-pressure piston 28. In addition, a further magazine 29 is provided with a receiving element 30*a* for a further high-pressure seal 30 for sealing the further high-pressure piston 28 in a first operating state of the further magazine 29 and is provided with at least one further receiving element 31*a* for a further replacement high-pressure seal 31 for sealing the further high-pressure piston 28 in a second operating state of the further magazine 29. A further changeover device 32 is provided for transferring the further magazine 29 between the first operating position and the second operating position. The further magazine 29 and the further changeover device 32 can be configured identically to the magazine 10 or the changeover device 13 so that repetitions should be dispensed with.

Figure 13:
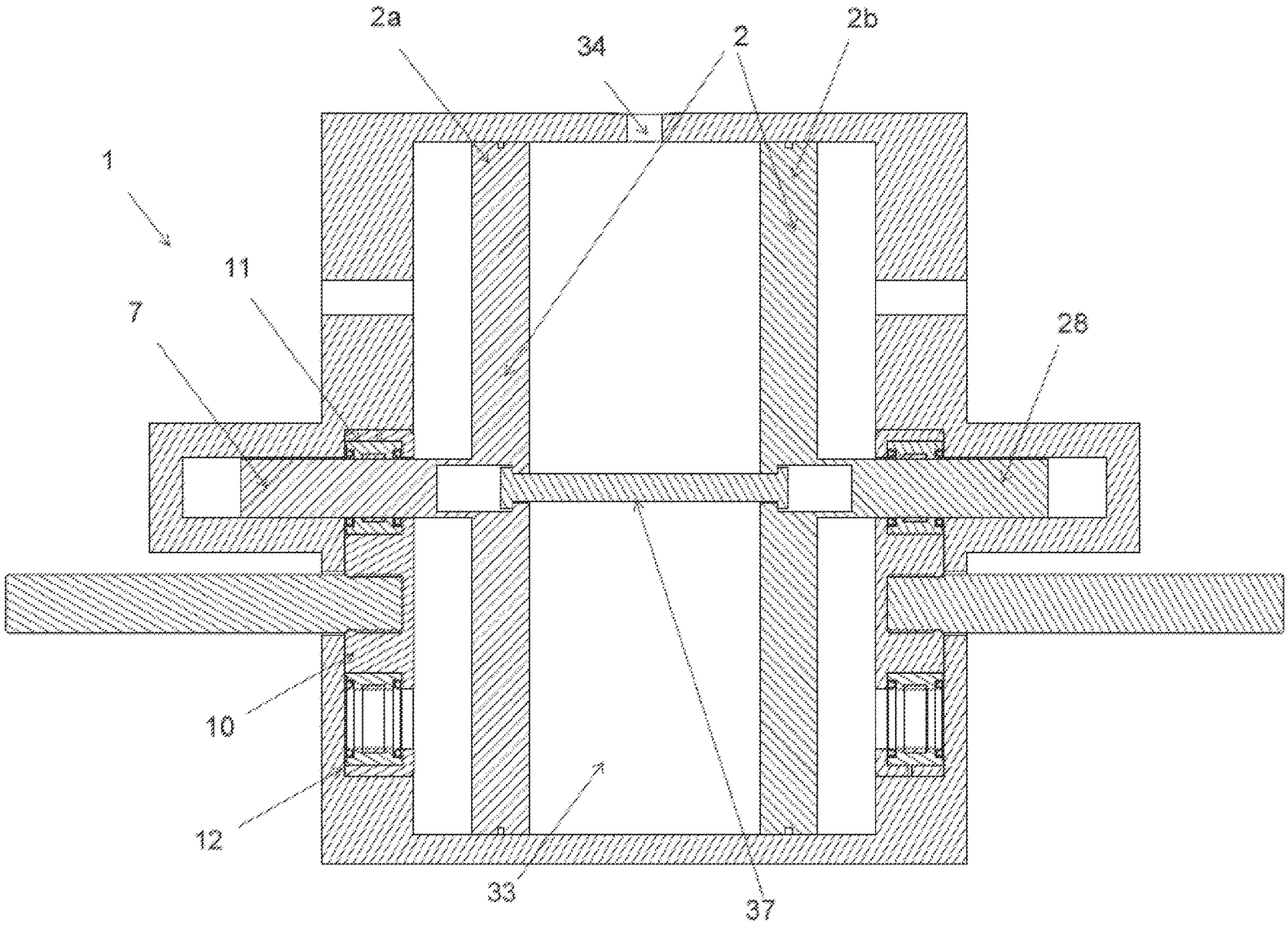
FIGS. 13, 14 each show a third embodiment of the compressor according to the invention in which the release of the high-pressure seal from the high-pressure piston is effected by shifting the high-pressure piston between the first operating position (cf.
Figure 14:
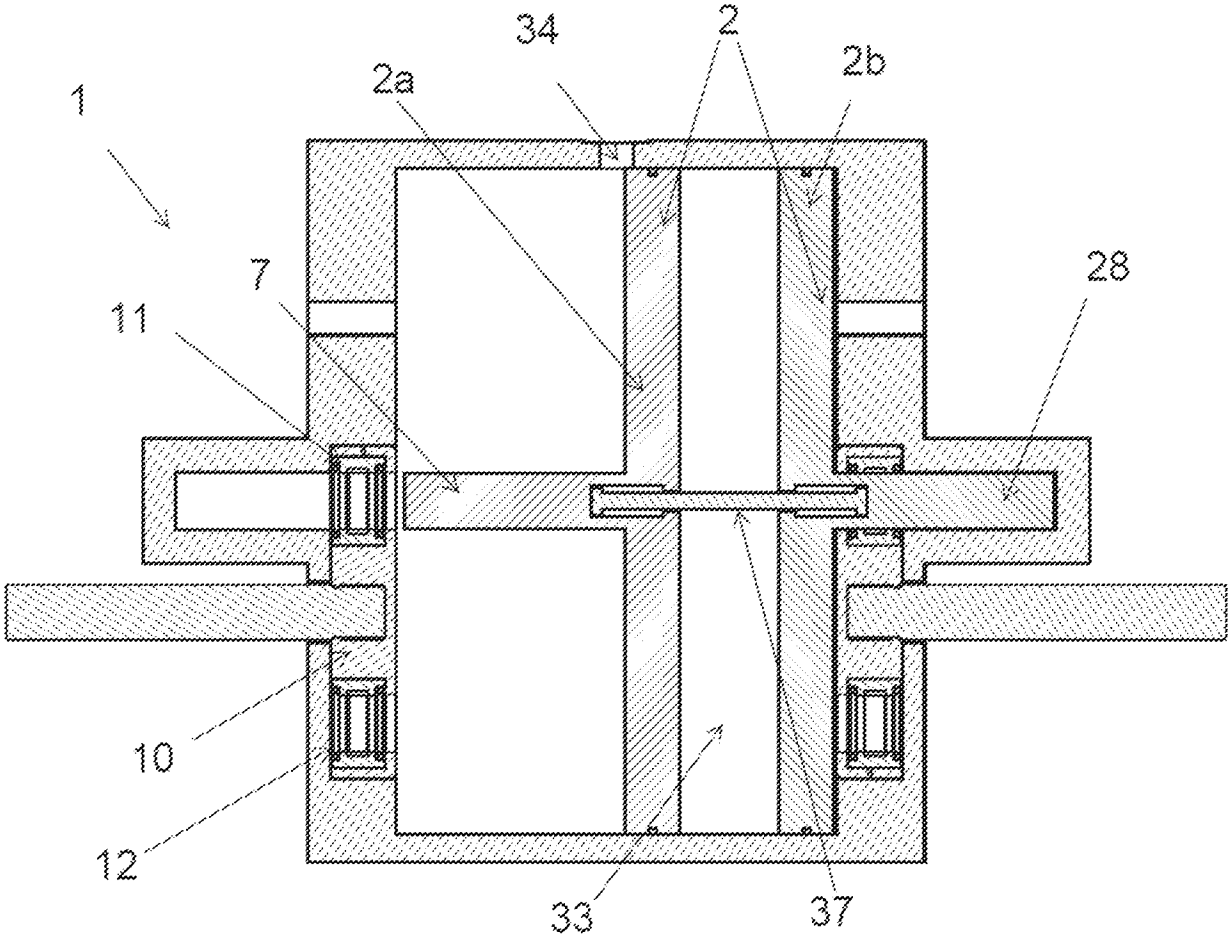

FIGS. 13, 14 show a third embodiment of the compressor 1 in which—as in the second embodiment-a double-acting drive piston 2 is provided with a further high-pressure piston 28. In this embodiment, furthermore a pressure chamber (space) 33 is formed between a first piston element 2*a* of the drive piston 2 and a second piston element 2*b* of the drive piston 2. The first piston element 2*a* and the second piston element 2*b* are connected to one another via a connecting rod 37. The pressure chamber 33 is connected to a pressure line 34 (only indicated schematically) in order to adjust the pressure in the pressure chamber 33. In the first operating position (cf. FIG. 14) a first higher pressure is provided in the pressure chamber 33. For transferring the magazine 10 into the first intermediate position a second lower pressure is set in the pressure chamber 33 so that the axial spacing between the first piston element 2*a* and the second piston element 2*b* is reduced compared with the first operating position. As a result, the high-pressure seal 11 slips from the high-pressure piston 7. The magazine 10 can then be brought into the second intermediate position. By raising the pressure in the pressure chamber 33 to the first pressure, the second operating position of the magazine 10 is reached in which the replacement high-pressure seal 12 is arranged sealingly on the high-pressure piston 7.

Figure 15:
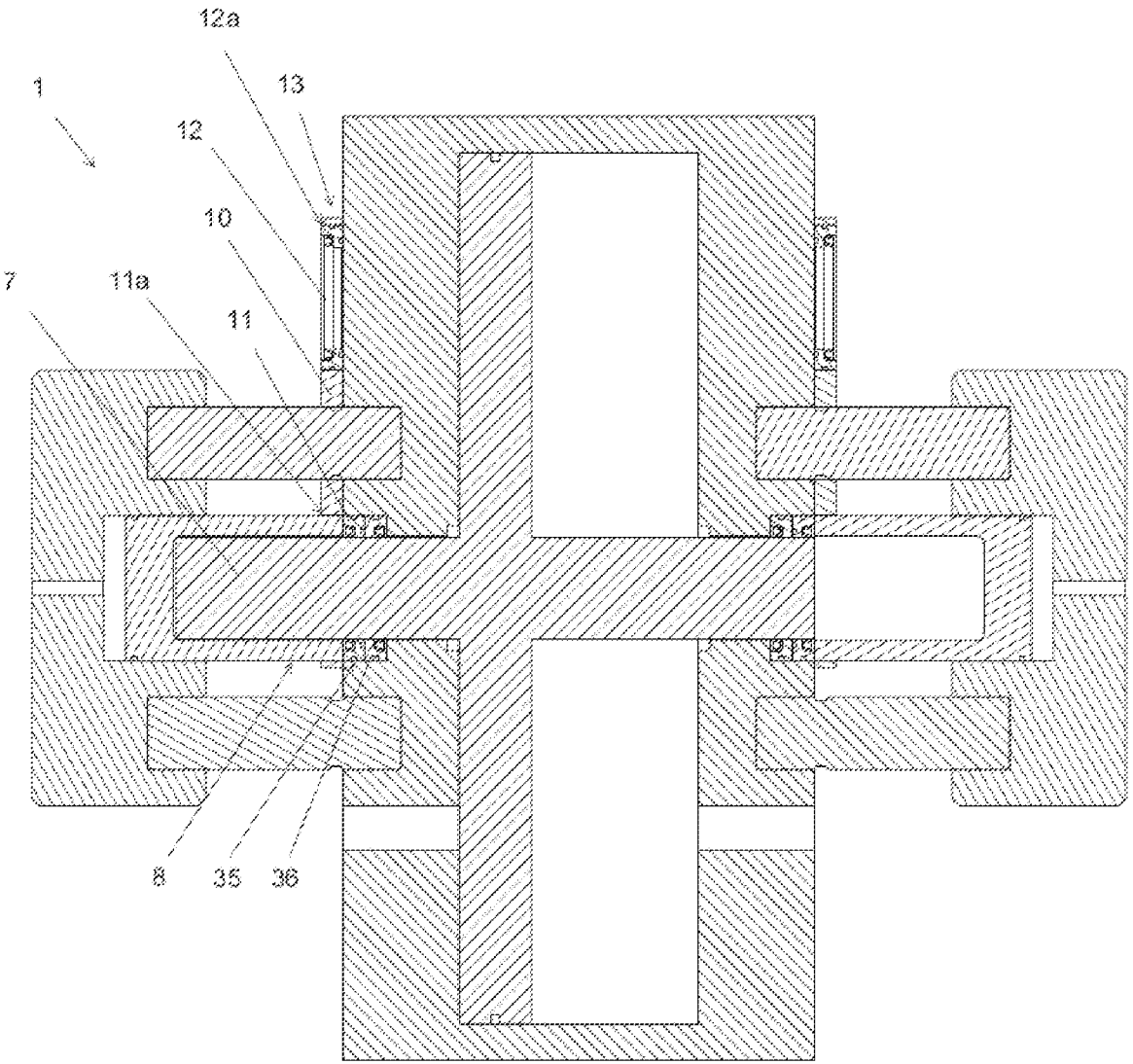
FIGS. 15, 16 each show a fourth embodiment of the compressor according to the invention in which the high-pressure seal in the first operating position (cf.
Figure 16:
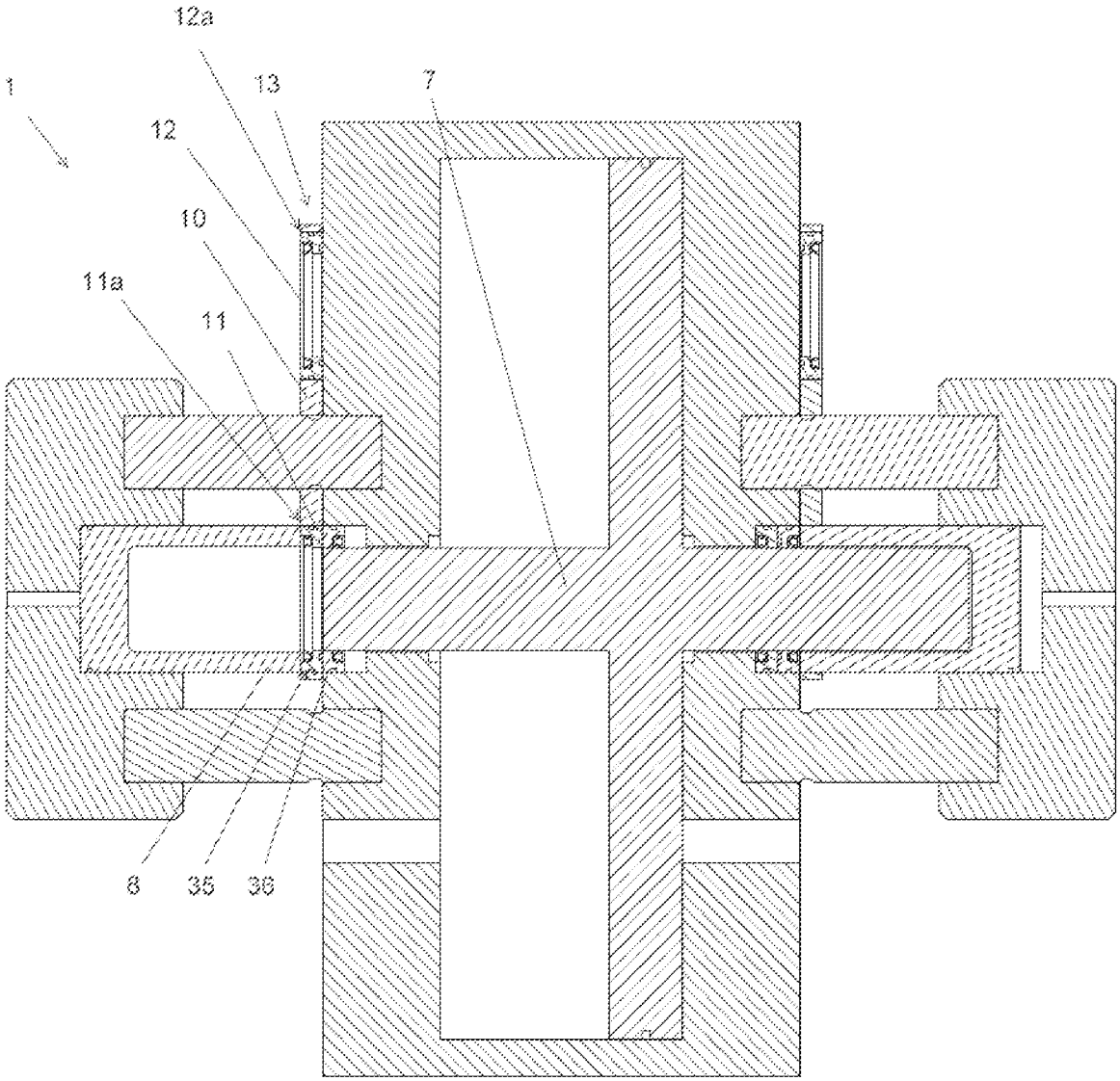

FIGS. 15, 16 show a fourth embodiment of the compressor 1. In this embodiment the receptacle 11*a* on the magazine 10 in the first operating position (cf. FIG. 15) is located in the empty state. When viewed in the axial direction, the high-pressure seal 11 is arranged outside the receptacle 11*a* of the magazine 10 in a circumferential recess 35 of a housing of the pressure converter between a free end region of the second cylinder 8 and an annularly circumferential pressure part 36.

For replacing the high-pressure seal 11 by the replacement high-pressure seal 12, the high-pressure seal 11 is initially received in the receptacle 11*a* on the magazine 10. For this purpose, the pressure part 36 is pushed away from the drive piston 2 by means of the changeover device 13 so that the high-pressure seal 11 bearing against the pressure part 36 is displaced together with the second cylinder 8 also in the axial direction. The pressure part 36 can be actuated pneumatically, for example. Optionally the high-pressure piston 7 must then be shifted into the suitable end position so that the high-pressure seal 11 is released from the high-pressure piston 7. The magazine 10 together with the replacement high-pressure seal 12 is then transferred into the second intermediate position in which the replacement high-pressure seal 12 is arranged in the recess 35 of the second cylinder 8. In the embodiment shown, thus is achieved by pivoting the magazine 10. Finally the replacement high-pressure seal 12 is pushed out axially from the further receptacle 12*a* by displacement of the second cylinder 8 by means of the changeover device, whereby the second operating position is reached.

In the fourth embodiment, the displacement of the high-pressure seal and the replacement high-pressure seal is preferably brought about by a displacement of the second cylinder 8 substantially in the direction of the central axis of the high-pressure piston.

FIGS. 1-16 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The foregoing description is considered as illustrative only of the principles of the invention. Further, since numerous modifications and changes will readily occur to those skilled in the art, it is not desired to limit the invention to the exact construction and processes shown and described herein. Accordingly, all suitable modifications and equivalents may be considered as falling within the scope of the invention as defined by the claims which follow.

The invention claimed is:

1. A method for compressing molecular hydrogen comprising the steps of:

moving a high-pressure piston back and forth within a cylinder between a first end position and a second end position to compress the molecular hydrogen;

arranging a high-pressure seal for sealing the high-pressure piston;

arranging a magazine with a receptacle for the high-pressure seal and with at least one replacement high-pressure seal in a first operating position in which the high-pressure piston is sealed by the high-pressure seal; and transferring the magazine from the first operating position into a second operating position in which the high-pressure piston is sealed by the replacement high-pressure seal, wherein the high-pressure seal, in the first operating position, and the replacement high-pressure seal, in the second operating position, respectively, sits sealingly on a cylindrical sealing surface of the high-pressure piston moving back and forth between the first end position and the second end position to compress the molecular hydrogen, the cylindrical sealing surface of the high-pressure piston having a constant distance from a central axis of the high-pressure piston, and wherein in the first operating position only the high-pressure seal is circumferentially surrounding the high-pressure piston and in the second operating position only the replacement high-pressure seal is circumferentially surrounding the high-pressure piston.

2. A method for compressing a working medium comprising the steps of:

moving a drive piston driven by means of a drive medium within a first cylinder between a first end position and a second end position;

moving a high-pressure piston which compresses the working medium within a second cylinder between a first end position and a second end position;

arranging a high-pressure seal for sealing the high-pressure piston;

arranging a magazine with a receptacle for the high-pressure seal and with at least one replacement high-pressure seal in a first operating position in which the high-pressure piston is sealed by the high-pressure seal; and transferring the magazine from the first operating position into a second operating position in which the high-pressure piston is sealed by the replacement high-pressure seal, wherein in the first operating position only the high-pressure seal is circumferentially surrounding the high-pressure piston and in the second operating position only the replacement high-pressure seal is circumferentially surrounding the high-pressure piston.

* * * * *